US006834641B2

(12) United States Patent
Watanabe

(10) Patent No.: US 6,834,641 B2
(45) Date of Patent: Dec. 28, 2004

(54) FUEL INJECTION SYSTEM FOR INTERNAL COMBUSTION ENGINE

(75) Inventor: Tsuguo Watanabe, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/645,629

(22) Filed: Aug. 22, 2003

(65) Prior Publication Data

US 2004/0069282 A1 Apr. 15, 2004

(30) Foreign Application Priority Data

Sep. 3, 2002 (JP) ..... 2002-258211

(51) Int. Cl.[7] ..... F02M 51/00
(52) U.S. Cl. ..... 123/478; 123/480; 123/491
(58) Field of Search ..... 123/478, 480, 123/491, 492

(56) References Cited

U.S. PATENT DOCUMENTS 4,473,052 A * 9/1984 Kamiyama et al. ..... 123/478
4,922,877 A * 5/1990 Nagaishi ..... 123/682
5,762,055 A * 6/1998 Yamashita et al. ..... 123/677

FOREIGN PATENT DOCUMENTS

JP 10196440 A 7/1998

* cited by examiner

*Primary Examiner*—John T. Kwon
(74) *Attorney, Agent, or Firm*—Birch, Stewart, Kolasch & Birch, LLP

(57) ABSTRACT

In a fuel injection system for an internal combustion engine in which fuel injectors are arranged on the upstream side and on the downstream side of the throttle valve, respectively, the throttle valve will be prevented from freezing without involving the addition of piping and the like. A fuel injection system for an internal combustion engine includes a device for determining a total injection quantity of each fuel injector, a device for determining a rate of fuel injection for each fuel injector, a device for acquiring temperature information representing the throttle valve temperature, and a device for correcting the fuel injection rate on the basis of the temperature information. The correction device decreases the injection rate of the upstream fuel injector when the throttle valve is at a low temperature.

14 Claims, 5 Drawing Sheets

FIG. 3
| | Cne00 | Cne01 | | Cnei | | Cne14 |
|---|---|---|---|---|---|---|
| Cth0 | Rupper (0, 0) | Rupper (1, 0) | | Rupper (i, 0) | | Rupper (14, 0) |
| Cth1 | : | : | | : | | : |
| Cth2 | : | : | | : | | : |
| : | : | : | | : | | : |
| Cthj | Rupper (0, j) | Rupper (1, j) | | Rupper (i, j) | | Rupper (14, j) |
| : | : | : | | : | | : |
| Cth7 | : | : | | : | | : |
| Cth8 | : | : | | : | | : |
| Cth9 | Rupper (0, 9) | Rupper (1, 9) | | Rupper (i, 9) | | Rupper (14, 9) |
FIG. 4
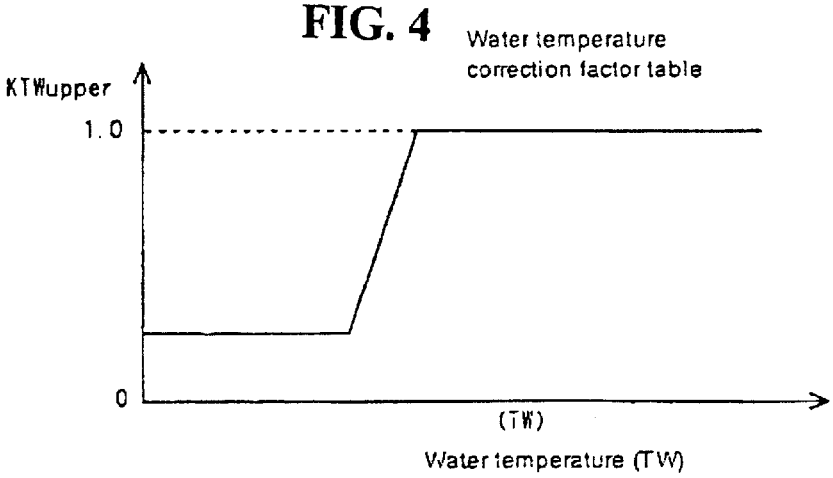
FIG. 5
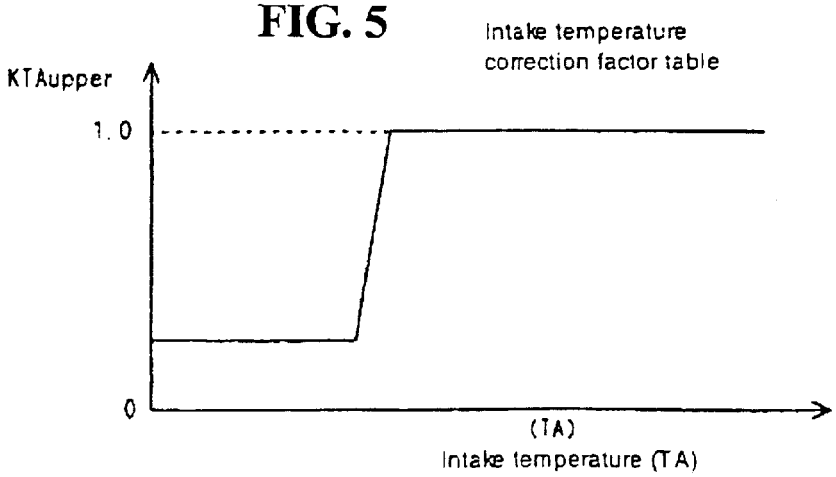

FUEL INJECTION SYSTEM FOR INTERNAL COMBUSTION ENGINE

CROSS-REFERENCE TO RELATED APPLICATIONS

This nonprovisional application claims priority under 35 U.S.C. § 119(a) on Patent Application No. 2002-258211, filed in Japan on Sep. 3, 2002, the entirety of which is incorporated herein by reference.

BACKGROUND OF THE INVENTION

1. Field of the Invention

The present invention relates to a fuel injection system for an internal combustion engine. More particularly, the present invention relates to a fuel injection system in which injection valves have been provided on an upstream side and on a downstream side, respectively, with a throttle valve interposed therebetween.

2. Description of Background Art

When a fuel injector is provided upstream from a throttle valve, the volumetric efficiency is improved because heat is taken from intake air when injection fuel vaporizes. Therefore, the engine output can be increased as compared with when the fuel injector is provided downstream from the throttle valve. On the other hand, when the fuel injector is provided on the upstream side, a distance between the fuel injection port and the combustion chamber inevitably becomes increases. Accordingly, a response lag occurs in fuel transport as compared with when the fuel injector is provided downstream from the throttle valve. This causes the driveability of the engine to deteriorate.

Japanese Patent Laid-Open Nos. 4-183949 and 10-196440 have attempted to solve such technical problems. Specifically, the above documents have attempted to improve engine output, while ensuring that the driveability of the engine and the engine output are compatible. The above documents disclose a fuel injection system in which fuel injectors have been provided on the upstream side and on the downstream side of the intake pipe, respectively, with the throttle valve interposed therebetween.

FIG. 7 is a cross-sectional view showing a major portion of an internal combustion engine according to the background art. Two fuel injectors 50*a* and 50*b* have been arranged with a throttle valve 52 of an intake pipe 51 interposed therebetween. The downstream fuel injector 50*a* is arranged on a side portion of the downstream side (engine side) of the throttle valve 52 and the upstream fuel injector 50*b* is arranged on the upstream side (air cleaner side) of the throttle valve 52. A lower end portion of the intake pipe 51 is connected to an intake passage 52. An intake port 53, which faces a combustion chamber of the intake passage 52, is opened and closed by an intake valve 54.

In Japanese Patent Laid-Open No. 8-135506, a technique has been disclosed in which a hot water passage has been formed on the throttle body in the vicinity of the intake passage. The hot water passage is provided for circulating engine cooling water, and the cooling water heated by the engine is caused to circulate in the hot water passage to thereby heat the throttle body for preventing the throttle body from freezing.

In the above-described technique; however, piping is required for introducing the engine cooling water to the throttle body to circulate from the engine body through the throttle body. Such piping requires a complicated structure to conduct a large quantity of heat from the engine body to the throttle body. Therefore, the space required for the installation of the throttle body and the weight increases, and the assembly process becomes complicated. In view of this, the manufacturing costs increase.

SUMMARY OF THE INVENTION

It is an object of the present invention to solve the above-described problems of the background art. Specifically, it is an object of the present invention to provide, a fuel injection system for an internal combustion engine which is capable of preventing the throttle valve from freezing without involving the addition of piping and the like in a structure in which fuel injectors are arranged on the upstream side and on the downstream side of the throttle valve, respectively.

In order to achieve the above-described object, a fuel injection system for an internal combustion engine according to the present invention includes an upstream fuel injector provided upstream from the throttle valve and a downstream fuel injector provided downstream from the throttle valve. The fuel injection system comprises means for determining a total injection quantity due to the upstream and downstream fuel injectors; means for determining a rate of fuel injection quantities due to the upstream and downstream fuel injectors; means for acquiring temperature information representing temperature of the throttle valve; and means for correcting the rate on the basis of the temperature information, wherein the correction means decreases the injection rate of the upstream fuel injector when the temperature of the throttle valve is lower than a predetermined temperature.

According to the above-described feature, when the throttle valve is at low temperature, the injection rate of the upstream fuel injector is restricted to a low amount. Accordingly, the quantity of fuel to be injected to the throttle valve is reduced. As a result, the total quantity of the heat of vaporization to be taken when the fuel vaporizes is restricted to a low value. Accordingly, the throttle valve can be prevented from freezing. In addition, the total injection quantity due to the upstream and downstream fuel injectors is maintained constant. In view of this, it is possible to prevent fuel shortages due to the injection quantity of the upstream fuel injector being reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a view showing an example of an injection rate table;

FIG. 4 is a view showing an example of a water temperature correction factor table;

FIG. 5 is a view showing an example of an intake temperature correction factor table;

DETAILED DESCRIPTION OF THE PREFERRED EMBODIMENTS

Figure 1:
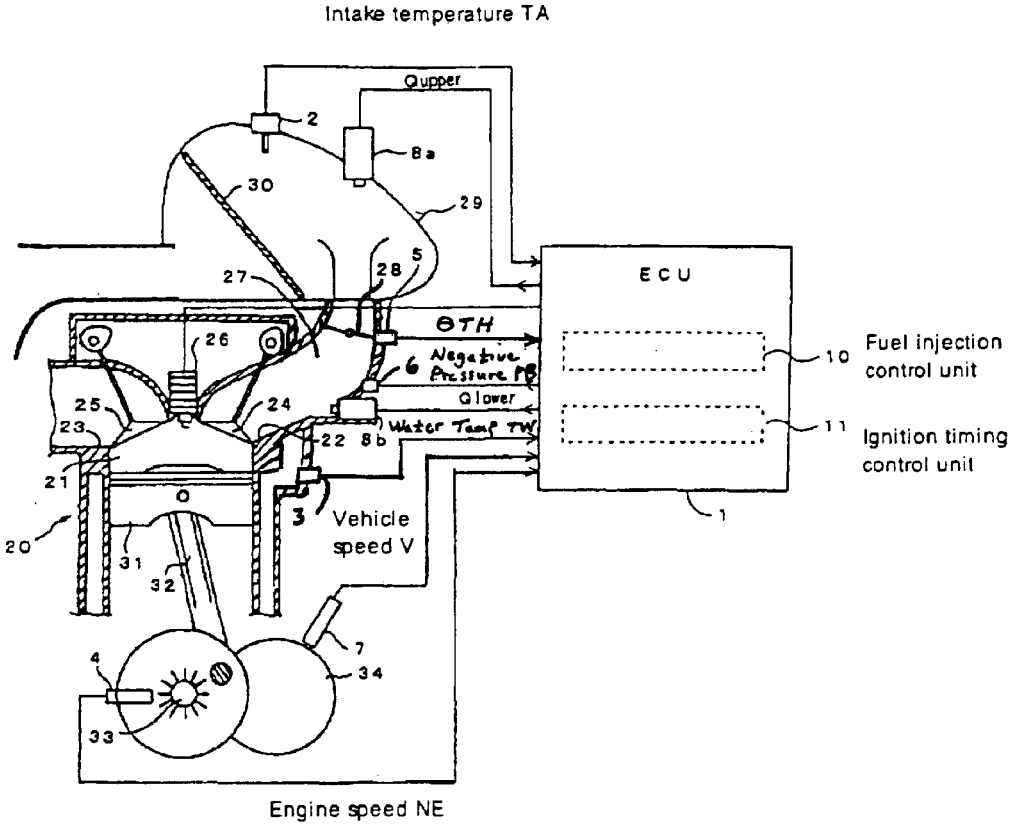
FIG. 1 is a general block diagram showing a fuel injection system according to an embodiment of the present invention.

A preferred embodiment of the present invention will now be described in detail with reference to the accompanying drawings. FIG. 1 is a general block diagram showing a fuel injection system according to one embodiment of the present invention. A combustion chamber 21 of the engine 20 includes an intake port 22 and an exhaust port 23 opening therein. Each port 22 and 23 is provided with an intake valve 24 and an exhaust valve 25, respectively. An ignition plug 26 is provided extending into the combustion chamber 21.

A throttle valve 28 is provided on an intake passage 27 leading to the intake port 22 for adjusting a quantity of intake air in accordance with the throttle opening θTH. A throttle sensor 5 is provided for detecting the throttle opening θTH and a vacuum sensor 6 is provided for detecting intake manifold vacuum PB. An air cleaner 29 is provided at a terminal of the intake passage 27. An air filter 30 is provided within the air cleaner 29. Outside air is taken into the intake passage 27 through the air filter 30.

A downstream injection valve 8*b* is arranged in the intake passage 27 at a downstream location from the throttle valve 28. An upstream injection valve 8*a* is arranged on the air cleaner 29 at an upstream location from the throttle valve 28, so as to point toward the intake passage 27. An intake temperature sensor 2 is provided for detecting intake (atmospheric) temperature TA.

An engine speed sensor 4 is arranged opposite to a crankshaft 33, which is coupled to a piston 31 of the engine 20 through a connecting rod 32, for detecting engine speed NE on the basis of a rotation angle of the crankshaft 33 of the engine. Furthermore, a vehicle speed sensor 7 is arranged opposite to a rotor 34 such as a gear, which is coupled for rotation to the crankshaft 33, for detecting vehicle speed V. A water temperature sensor 3 is provided on a water jacket formed around the engine 20 for detecting cooling water temperature TW representing the engine temperature.

An ECU (Engine Control Unit) 1 includes a fuel injection control unit 10 and an ignition timing control unit 11. The fuel injection control unit 10 outputs, on the basis of signals (process values) obtained from each of the above-described sensors, injection signals Qupper and Qlower to each injection valve 8*a*, 8*b* on the upstream and downstream sides, respectively. Each of the injection signals is a pulse signal having a pulse width responsive to the injection quantity. Each injection valve 8*a*, 8*b* is opened by a time corresponding to the pulse width to inject the fuel. The ignition timing control unit 11 controls ignition timing of the ignition plug 26.

Figure 2:
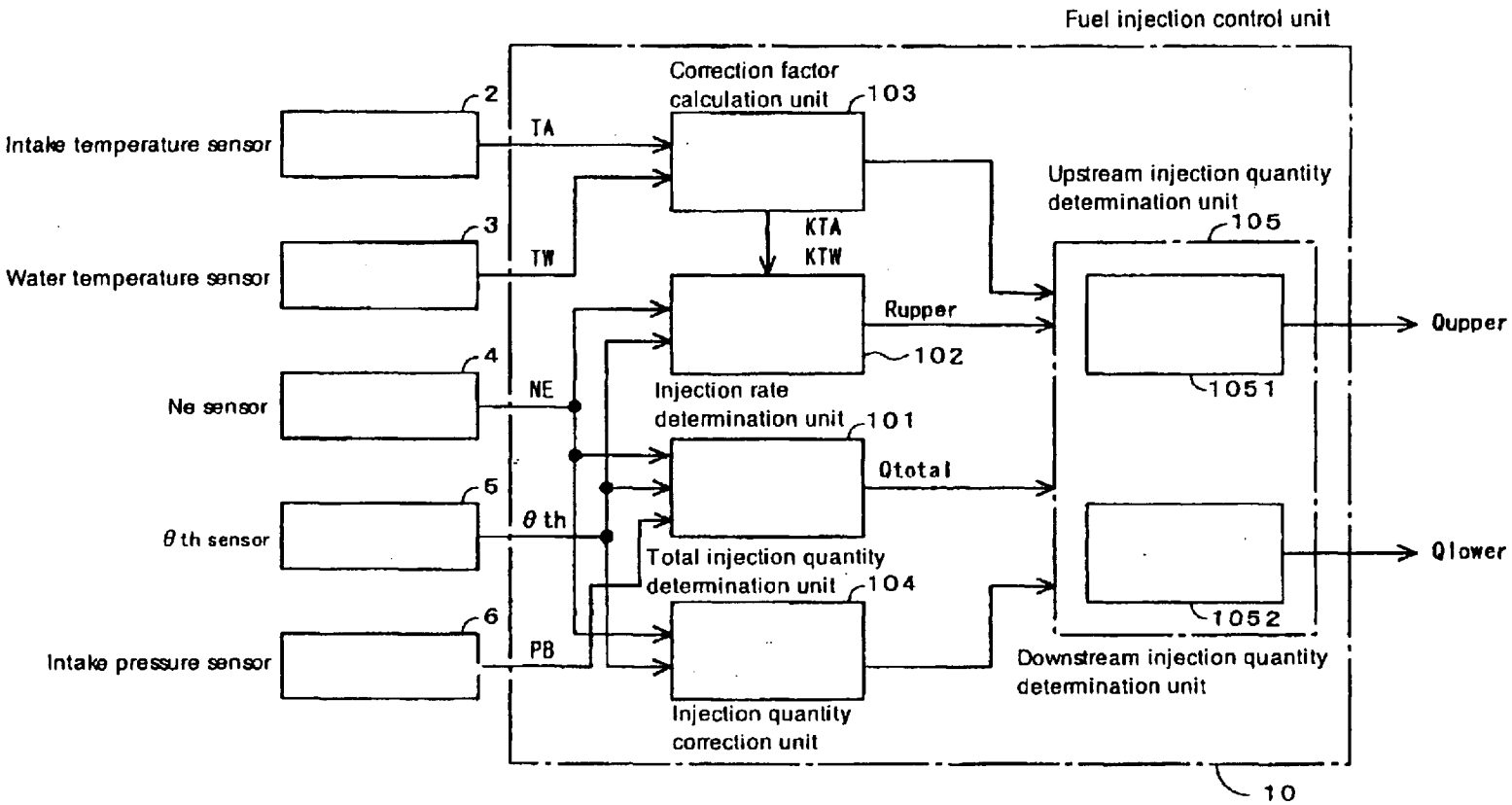
FIG. 2 is a functional block diagram showing a fuel injection control unit 10.

FIG. 2 is a functional block diagram for the fuel injection control unit 10. The same symbols have been used to identify the same or similar elements in FIG. 1.

A total injection quantity determination unit 101 determines a total quantity Qtotal of fuel to be injected from each fuel injector 8*a*, 8*b* on the upstream and downstream sides on the basis of the engine speed NE, the throttle opening θTH and the intake pressure PB. An injection rate determination unit 102 refers to an injection rate table on the basis of the engine speed NE and throttle opening θTH to determine an injection rate Rupper of the upstream injection valve 8*a*. An injection rate Rlower of the downstream injection valve 8*b* is determined as (1−Rupper).

FIG. 3 is a view showing an example of the injection rate table. In the present embodiment, an injection rate map includes 15 items (Cne00 to Cne14) as a reference for the engine speed NE, and 10 items (Cth0 to Cth9) as a reference for the throttle opening θTH. The injection rate Rupper of the upstream injection valve 8*a* is registered in advance at each combination of each engine speed NE and the throttle opening θTH. The injection rate determination unit 102 determines an injection rate Rupper corresponding to the engine speed NE and the throttle opening θTH that have been detected, by means of a four-point interpolation on the injection rate map.

Referring again to FIG. 2, the correction factor calculation unit 103 refers to an intake temperature correction factor table on the basis of the intake temperature TA detected, and seeks a correction factor KTAupper for reducing the injection quantity of the upstream injection valve 8*a* to a value smaller than the times when the throttle valve is at low temperature. The correction factor calculation unit 103 further refers to the water temperature correction factor table on the basis of the cooling water temperature TW detected, and seeks a correction factor KTWupper for reducing the injection quantity of the upstream injection valve 8*a* smaller than the times when the throttle valve is at low temperature.

FIGS. 4 and 5 are views illustrating examples of the water temperature correction factor table and the intake temperature correction factor table, respectively. When the cooling water temperature TW and the intake temperature TA are lower than a predetermined temperature, a correction factor lower than "1.0" is selected for both. These correction factors KTAupper and KTWupper are, as described later with reference to the flowchart, multiplied by the injection rate Rupper of the upstream injection valve 8*a*. The resulting product will be adopted as a new injection rate Rupper. Therefore, in the present embodiment, when the throttle valve is at a low temperature, the injection quantity Qupper of the upstream injection valve 8*a* is to be greatly reduced compared with all other times.

Referring again to FIG. 2, the injection quantity correction unit 104 corrects the injection quantity of each injection valve 8*a*, 8*b* during acceleration, when the throttle opening θth abruptly closes and at other times. In the injection quantity determination unit 105, the upstream injection quantity determination unit 1051 determines the injection quantity Qupper of the upstream injection valve 8*a* on the basis of the injection rate Rupper and the total injection quantity Qtotal. A downstream injection quantity determination unit 1052 determines the injection quantity Qlower of the downstream injection valve 8*b* on the basis of the upstream injection quantity Qupper and the total injection quantity Qtotal.

Figure 6:
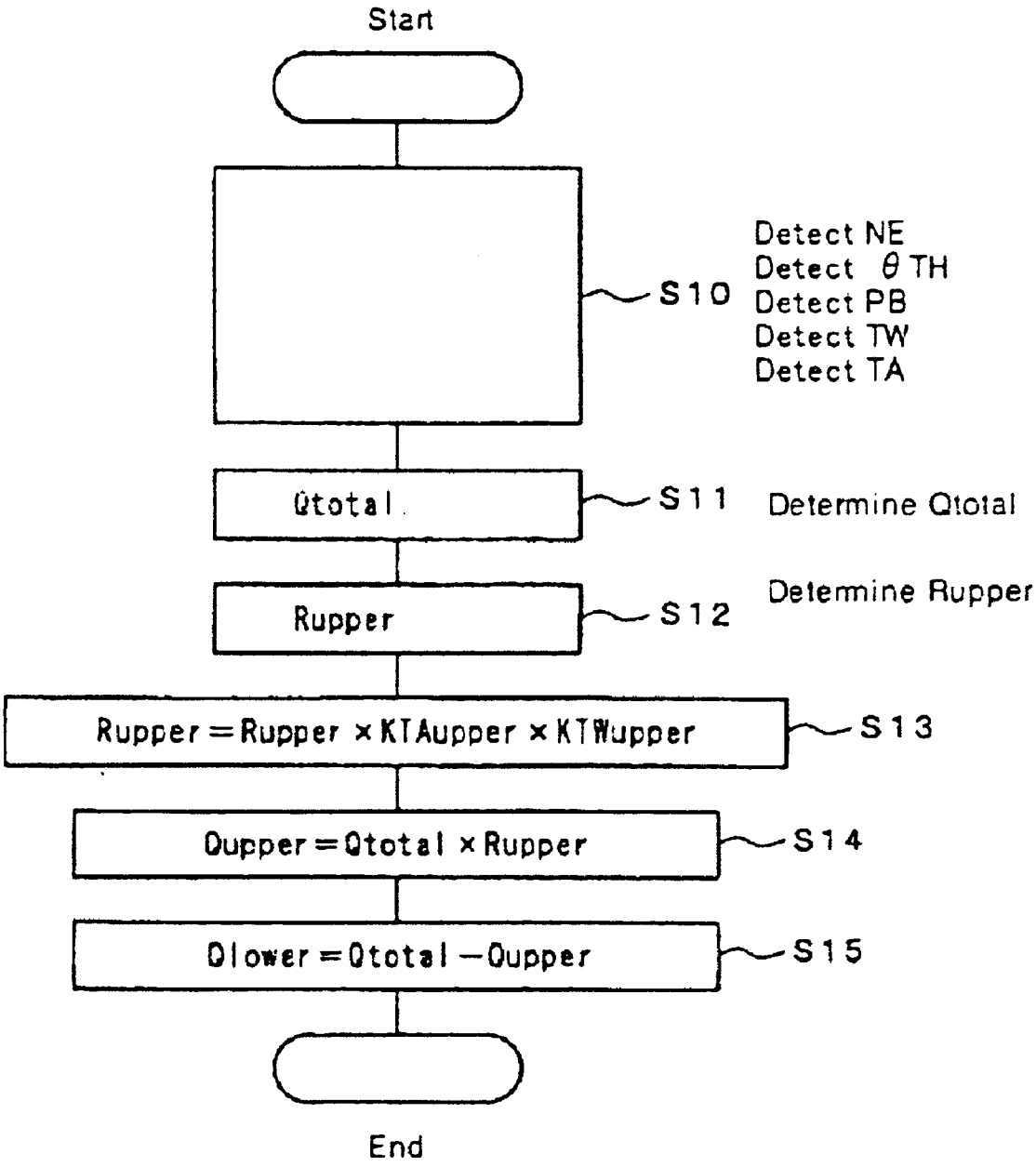
FIG. 6 is a flowchart showing a control procedure of fuel injection.
Figure 7:
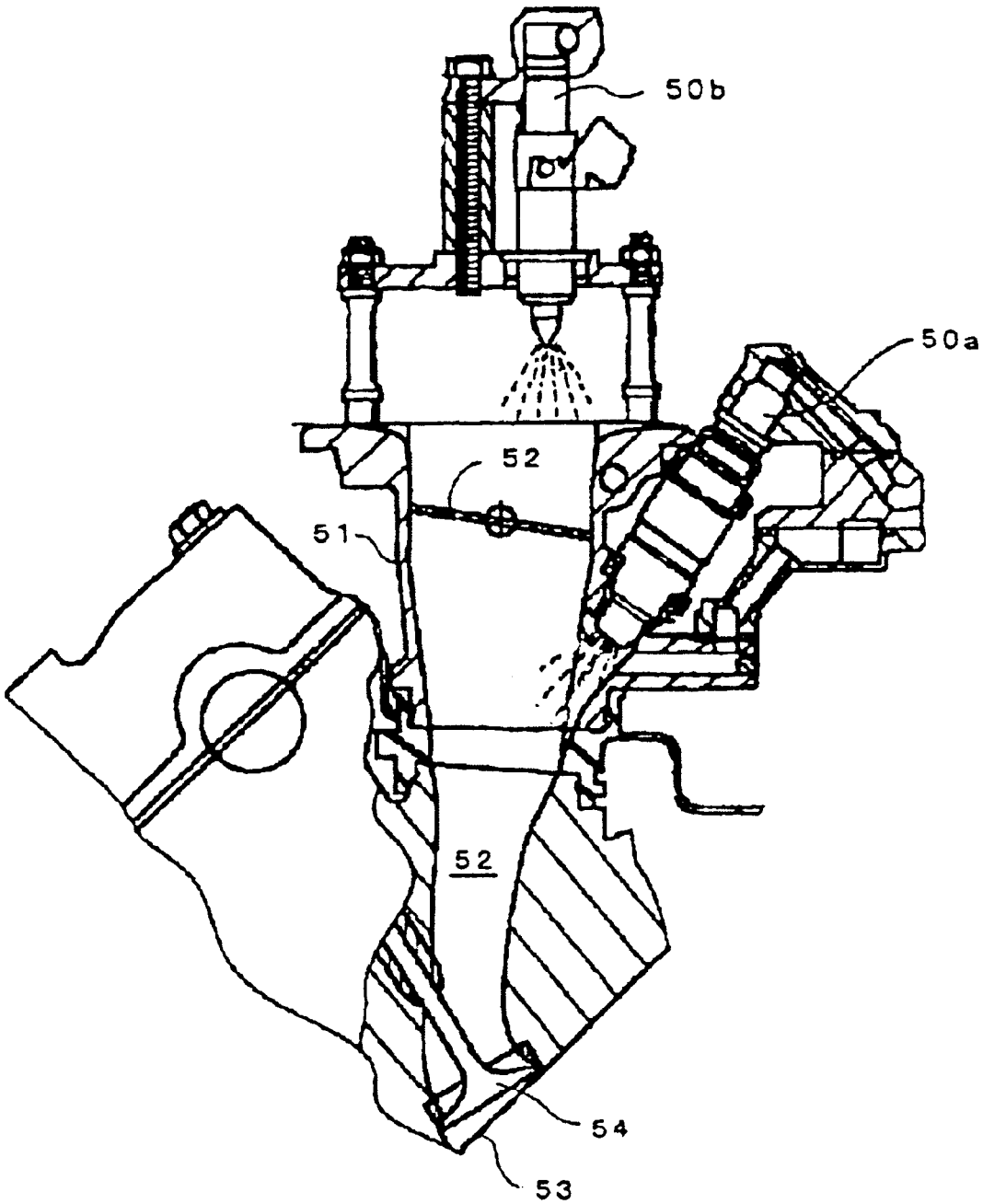
FIG. 7 is a cross-sectional view showing an internal combustion engine according to the background art, in which two fuel injectors have been arranged.

Referring to the flowchart of FIG. 6, a description will be provide of an operation of the fuel injection control unit 10 in detail. This handling is executed by interruption due to a crank pulse in a predetermined stage.

In a step S10, the engine speed NE, the throttle opening θTH, the manifold air pressure PB, the intake temperature TA and the cooling water temperature TW are detected by each of the above-described sensors. In a step S11, in the total injection quantity determination unit 101, total quantity Qtotal of fuel to be injected from each fuel injector 8*a*, 8*b* on the upstream side and on the downstream side is determined on the basis of the engine speed NE, the throttle opening θTH and the intake pressure PB.

In a step S12, in the injection rate determination unit 102, an injection rate table is referred to on the basis of the engine speed Ne and the throttle opening θTH, and an injection rate Rupper of the upstream injection valve 8*a* is determined. In a step S13, the injection rate Rupper is corrected on the basis of the following expression (1):

$$Rupper=Rupper\times KTWupper\times KTAupper \quad (1)$$

In a step S14, the upstream injection quantity determination unit 1051 calculates an injection quantity Qupper of the upstream injection valve 8*a* on the basis of the following expression (2):

$$Qupper=Qtotal\times Rupper \quad (2)$$

In a step S15, the downstream injection quantity determination unit 1052 calculates the injection quantity Qlower of the downstream injection valve 8*b* on the basis of the following expression (3):

$$Qlower=Qtotal-Qupper \quad (3)$$

When the injection quantity Qupper of the upstream injection valve 8*a* and the injection quantity Qlower of the downstream injection valve 8*b* are determined as described above, an injection signal having a pulse width responsive to each of the injection quantities Qupper, Qlower is outputted to each injection valve 8*a*, 8*b* at predetermined timing synchronized to the crank angle to inject fuel from each injection valve 8*a*, 8*b*.

In the above-described embodiment, the description has been made of a case where the injection quantity of the upstream injection valve 8*a* is reduced when the throttle valve is at low temperature. However, the injection may be completely stopped under certain circumstances.

According to the present invention, the following effects are achieved:

(1). When the throttle valve is at low temperature, the injection quantity Qupper of the upstream injection valve is reduced and the fuel to be sprayed on the throttle valve is reduced to restrict a drop in temperature due to the heat of vaporization being taken from intake air. Therefore, the throttle valve can be prevented from freezing.

(2). The injection quantity Qlower of the downstream injection valve is sought as a value obtained by deducting the injection quantity Qupper of the upstream injection valve from the total injection quantity Qtotal. Accordingly, a regular quantity of fuel can be supplied into the combustion chamber even if the injection quantity Qupper of the upstream injection valve is reduced by the drop in temperature of the throttle valve.

(3). It has been arranged such that the throttle valve temperature is represented by the intake temperature or the cooling water temperature. Accordingly, there is no need to provide a separate sensor for measuring the temperature of the throttle valve.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection system for an internal combustion engine having an intake pipe equipped with a throttle valve, an upstream fuel injector provided upstream from said throttle valve and a downstream fuel injector provided downstream from said throttle valve, said fuel injection system comprising:

means for determining a total injection quantity of the upstream and the downstream fuel injectors;

means for determining a rate of fuel injection of each of the upstream and the downstream fuel injectors;

means for acquiring temperature information representing a temperature of the throttle valve; and means for correcting said rate of fuel injection on the basis of said temperature information, wherein said correction means decreases the injection rate of the upstream fuel injector when the temperature of the throttle valve is lower than a first predetermined temperature.

2. The fuel injection system for an internal combustion engine according to claim 1, wherein said correction means stops said upstream fuel injector when the temperature of said throttle valve is a second predetermined temperature lower than said first predetermined temperature.

3. The fuel injection system for an internal combustion engine according to claim 1, wherein said means for acquiring said temperature information detects at least one of atmospheric temperature and cooling water temperature of the engine.

4. The fuel injection system for an internal combustion engine according to claim 2, wherein said means for acquiring said temperature information detects at least one of the atmospheric temperature and cooling water temperature of the engine.

5. The fuel injection system for an internal combustion engine according to claim 1, wherein the total injection quantity is determined on the basis of a speed of the engine, a throttle opening of the engine and an intake pressure of the engine.

6. The fuel injection system for an internal combustion engine according to claim 1, wherein the rate of fuel injection of each of the upstream and the downstream fuel injectors is determined from an injection rate table on the basis of a speed of the engine and a throttle opening of the engine.

7. The fuel injection system for an internal combustion engine according to claim 1, further comprising means for correcting an injection quantity of each of the upstream and the downstream fuel injectors, wherein the injection quantity of the upstream fuel injector is determined on the basis of the total injection quantity and the injection rate of the upstream fuel injector, and the injection quantity of the downstream fuel injector is determined on the basis of the injection quantity of the upstream fuel injector and the total injection quantity.

8. A method for injecting fuel in an internal combustion engine having an intake pipe equipped with a throttle valve, an upstream fuel injector provided upstream from said throttle valve and a downstream fuel injector provided downstream from said throttle valve, said method comprising the steps of:

determining a total injection quantity of the upstream and the downstream fuel injectors;

determining a rate of fuel injection of each of the upstream and the downstream fuel injectors;

acquiring temperature information representing a temperature of the throttle valve; and correcting said rate of fuel injection quantities on the basis of said temperature information, wherein said correction means decreases the injection rate of the upstream fuel injector when the temperature of the throttle valve is lower than a first predetermined temperature.

9. The method according to claim 8, wherein said correction means stops said upstream fuel injector when the temperature of said throttle valve is a second predetermined temperature lower than said first predetermined temperature.

10. The method according to claim 8, wherein said means for acquiring said temperature information detects at least one of atmospheric temperature and cooling water temperature of the engine.

11. The method according to claim 9, wherein said means for acquiring said temperature information detects at least one of the atmospheric temperature and cooling water temperature of the engine.

12. The method according to claim 8, wherein the total injection quantity is determined on the basis of a speed of the engine, a throttle opening of the engine and an intake pressure of the engine.

13. The method according to claim 8, wherein the rate of fuel injection of each of the upstream and the downstream fuel injectors is determined from an injection rate table on the basis of a speed of the engine and a throttle opening of the engine.

14. The method according to claim 8, further comprising the step of correcting an injection quantity of each of the upstream and the downstream fuel injectors, wherein the injection quantity of the upstream fuel injector is determined on the basis of the total injection quantity and the injection rate of the upstream fuel injector, and the injection quantity of the downstream fuel injector is determined on the basis of the injection quantity of the upstream fuel injector and the total injection quantity.

* * * * *